US009320414B2

(12) United States Patent
Fritz et al.

(10) Patent No.: US 9,320,414 B2
(45) Date of Patent: Apr. 26, 2016

(54) WATER-CHANNELLING DOMESTIC APPLIANCE, IN PARTICULAR A DISHWASHER

(75) Inventors: Heiko Fritz, Herbrechtingen (DE); Michael Georg Rosenbauer, Reimlingen (DE); Bernd Schwenk, Lauingen (DE); Egbert Classen, Stahnsdorf (DE)

(73) Assignee: BSH Hausgeraete GmbH, Munich (DE)

( * ) Notice: Subject to any disclaimer, the term of this patent is extended or adjusted under 35 U.S.C. 154(b) by 609 days.

(21) Appl. No.: 13/809,170

(22) PCT Filed: Jul. 27, 2010

(86) PCT No.: PCT/EP2010/060922
§ 371 (c)(1), (2), (4) Date: Jan. 9, 2013

(87) PCT Pub. No.: WO2012/007062
PCT Pub. Date: Jan. 19, 2012

(65) Prior Publication Data

US 2013/0106264 A1 May 2, 2013

(30) Foreign Application Priority Data

Jul. 16, 2010 (DE) ..... 10 2010 031 492

(51) Int. Cl.

| | |
|---|---|
| ***A47L 15/42*** | (2006.01) |
| ***D06F 39/12*** | (2006.01) |
| ***G10K 11/162*** | (2006.01) |

(52) U.S. Cl.
CPC ..... *A47L 15/4255* (2013.01); *A47L 15/4246* (2013.01); *D06F 39/12* (2013.01); *G10K 11/162* (2013.01); *Y10T 29/49826* (2015.01)

(58) Field of Classification Search
CPC ..... A47L 15/4255
See application file for complete search history.

(56) References Cited

U.S. PATENT DOCUMENTS

| | | | |
|---|---|---|---|
| 4,287,263 | A | 9/1981 | Woodring et al. |
| 4,308,308 | A | 12/1981 | Sachse |
| 4,734,323 | A | 3/1988 | Sato et al. |
| 4,825,974 | A | 5/1989 | Hoffmann et al. |
| 5,094,318 | A | 3/1992 | Maeda et al. |
| 5,712,038 | A | 1/1998 | Yamazaki et al. |
| 5,855,353 | A | 1/1999 | Shaffer |

(Continued)

FOREIGN PATENT DOCUMENTS

| | | | |
|---|---|---|---|
| DE | 4110291 | A1 | 10/1992 |
| DE | 4227957 | A1 | 2/1994 |

(Continued)

OTHER PUBLICATIONS

Report of Examination including national Search Report CN 201080068081.9 issued Jun. 26, 2014.
International Search Report PCT/EP2010/060922 dated Apr. 29, 2011.
National Search Report EP 11 17 2613 dated Oct. 8, 2012.

*Primary Examiner* — Jason Ko
(74) *Attorney, Agent, or Firm* — James E. Howard; Andre Pallapies

(57) ABSTRACT

A water-conducting household appliance includes a wash compartment and a sound-deadening layered mat which is applied externally to at least one wall of the wash compartment at a region which has a higher level of operational vibration than another region of the wall. The first layered mat is in particular a bitumen mat.

27 Claims, 3 Drawing Sheets

(56) References Cited

U.S. PATENT DOCUMENTS

| | | | |
|---|---|---|---|
| 5,965,851 | A | 10/1999 | Herreman et al. |
| 6,109,389 | A | 8/2000 | Hiers et al. |
| 6,152,259 | A | 11/2000 | Freist et al. |
| 6,231,967 | B1 | 5/2001 | Neukirchen |
| 2006/0266385 | A1 | 11/2006 | Malaker |
| 2007/0119481 | A1 | 5/2007 | Jerg |
| 2008/0001431 | A1 | 1/2008 | Thompson et al. |
| 2010/0024851 | A1 | 2/2010 | Rockwell et al. |

FOREIGN PATENT DOCUMENTS

| | | | |
|---|---|---|---|
| DE | 19803527 | A1 | 2/1999 |
| DE | 19812942 | A1 | 9/1999 |
| DE | 19858002 | A1 | 6/2000 |
| DE | 102005061805 | A1 | 6/2007 |
| DE | 102006015498 | A1 | 10/2007 |
| DE | 102008030539 | A1 | 12/2009 |
| EP | 0244615 | A2 | 11/1987 |
| WO | 2007020241 | A2 | 2/2007 |
| WO | 2009156330 | A1 | 12/2009 |

WATER-CHANNELLING DOMESTIC APPLIANCE, IN PARTICULAR A DISHWASHER

BACKGROUND OF THE INVENTION

The invention relates to a water-conducting household appliance, in particular a dishwasher, and a method for producing such a water-conducting household appliance.

To dampen structure-borne sound or deaden the sound from metal components, in particular stainless steel wash containers of automatic dishwashers, it is known to bond polymer-modified bitumen mats with an appropriate loss factor to the metal surfaces of the wash compartment of the respective dishwasher. This is done during mass production using a hot-melt bonder, which reacts to the application of external heat. Individual manufacture, small-scale production and structure-borne sound damping for temperature-sensitive metal components can be achieved as required using self-adhesive bitumen mats.

In a generic water-conducting household appliance a sound-deadening layered mat, in particular a bitumen mat, is applied to at least one wash compartment wall of a wash compartment or wash container. The bitumen mat is applied here essentially over a large area of the outside of the wash compartment in order to deaden the sound from the wash compartment as well as to reduce the generation of vibrations.

The bitumen mats with a high thermal capacity are generally bonded to the stainless steel compartment. The bitumen mats heat up during the heating phases and subsequent circulation periods of the dishwasher. Their energy absorption capacity here is a function of the mass and thermal capacity of the filler materials added to the bitumen mats. The thermal energy is absorbed by the bitumen mats and only returned to the wash chamber of the wash compartment to a very limited degree, so that a large proportion of the energy is lost.

BRIEF SUMMARY OF THE INVENTION

The object of the invention is to provide a water-conducting household appliance, in particular a dishwasher, and a method for producing such a water-conducting household appliance, which can be operated with reduced energy consumption.

According to the characterizing portion of the invention the sound-deadening layered mat is only applied to parts of at least one wash compartment wall region with a higher level of operational vibration, while a layered mat of a different material, in particular a thermally insulating layered mat, is applied to at least one wash compartment wall region with a lower level of operational vibration, in other words to wash compartment wall regions that are less critical in respect of a vibration sound effect.

The invention is based on the idea of applying sound-deadening layered mats, such as bitumen mats, specifically only in a spatially restricted manner, in other words to parts of those individual point or zones of the wash compartment where there is a large operationally produced vibration amplitude, while the zones of the respective wash compartment wall that are less critical in respect of their vibration sound effect remain free of, in other words uncovered by, such sound-deadening layers. In contrast according to the prior art bitumen mats are bonded to large areas of the outsides of the wash compartment. Therefore in the prior art the wash compartment is almost completely sheathed with bitumen mats bonded thereto. According to the invention however only very small sound-deadening layered mats are applied to parts or locally to deaden the sound from the stainless steel wash compartment, their position being limited to previously determined points that are of relevance in respect of vibration.

Tests have shown that such points that are of relevance in respect of vibration are in particular water input regions, where water sprays of the spray facilities of the water-conducting household appliance, in particular the dishwasher, strike the inner walls of the compartment, giving rise to such vibration noise there.

As according to the invention only a greatly reduced quantity of locally limited sound-deadening mat material is bonded to the outside of the wash compartment and the regions that are less critical in respect of vibration sound remain free of sound-deadening layered mats, less thermal energy is absorbed by the respective sound-deadening mat. Energy can thus be saved during operation of the appliance, resulting in a $CO_2$ reduction due to lower consumption values on the part of the household appliance during its operating periods. Energy can also be saved during the production process, as no energy consumption or only a reduced level thereof is required to activate the hot-melt bonder.

In a method for producing the household appliance, for effective noise insulation, the vibration behavior of the wash compartment is first tested during appliance operation, allowing the points on the wash compartment that are of relevance in respect of vibration to be determined This can be done before the sound-deadening layered mats are applied. The wash compartment wall region with greater operational vibration can in particular be a water input region, which is made to vibrate by water drops occurring during operation.

The respective partially applied sound-deadening layered mat can in particular be configured as a bitumen film or damping film (based on a non-bitumen material), which only has a very small mass compared with the heavy bitumen sound-deadening mats used hitherto in the prior art.

It can in particular be expedient if a sound-deadening layered mat is only applied to parts of at least one wash compartment wall region with a higher level of operational vibration and at least one layered mat of a different material, in particular a thermally insulating layered mat and/or sound absorption mat, is applied to at least one wash compartment wall region with a lower level of operational vibration. The additional layered material mat can be used in particular to ensure thermal insulation and/or sound absorption in the regions of the respective wash compartment wall adjacent to the sound-deadening layered mat applied to parts thereof. The additional layered material mat is preferably characterized by a low thermal conductivity. This allows the energy consumption of the water-conducting household appliance, in particular the dishwasher, to be reduced. A damping fleece or a foamed material with gas or air inclusions or a porous material, preferably a polyurethane foam, in particular can be selected for the additional layered material mat. In addition to or independently hereof the additional layered material mat exhibits the highest possible degree of absorption.

It can also be expedient for this additional layered material mat to cover a large area of the wash compartment wall compared with the sound-deadening layered mat that is only applied to parts of the wash compartment, in other words also to be positioned on the outside of the respective sound-deadening layered mat. This means that the region with the sound-deadening layered mat is also thermally insulated on the outside and/or is given a sound-absorbing outer layer.

It can also be expedient for at least one additional sound-insulating layered mat to be provided, which covers a large area of the respective wash compartment wall compared with the sound-deadening layered mat that is only applied to parts of the wash compartment. It is preferably positioned on the outside over the additional layered material mat, in particular thermally insulating layered mat and/or sound absorption mat. It is preferably configured as a heavy layer with a large mass and in particular the most closed surface possible. Bitumen material is particularly suitable for this. The respective sound-insulating layered mat ensures adequate air-borne sound insulation of the wash compartment.

It can be advantageous in some instances for the thermally insulating layered mat and/or the sound absorption mat and the additional sound-insulating mat to be configured as a single-piece material composite. This facilitates handling and assembly.

Of particular advantage is an insulating layered structure made of at least one sound-deadening layered mat, at least one thermally insulating layered mat and/or at least one sound-insulating layered mat, which are disposed essentially without a gap between the respective wash compartment wall and an outer housing wall. This allows perfect sound deadening and largely uninterrupted air-borne sound damping, thermal insulation and sound insulation around the wash compartment.

The insulating layered structure enclosing the wash compartment can therefore have an additional second sound-insulating layered mat in addition to the abovementioned sound-deadening layered mat or first sound-insulating layered mat and the thermally insulating layered mat, said second sound-insulating layered mat covering a large area of essentially the whole wash compartment wall compared with the first sound-insulating layered mat.

The additional sound-insulating layered mat can preferably be disposed outside the thermally insulating layered mat, so that the thermally insulating layered mat is disposed between the outer sound-insulating layered mat and the wash compartment.

To prevent thermal convection, gaps are avoided between the wash compartment wall and the appliance housing wall. In view of this, at least the thermally insulating layered mat and the abovementioned additional sound-insulating layered mat can preferably be configured as a single-piece material composite, without gaps being able to occur between the thermally insulating layered mat and the outer sound-insulating layered mat.

As mentioned above, according to the invention a number of sound-insulating layered mats can be applied at a distance from one another to the outside of the wash compartment. The sound-insulating layered mats are only applied at the points of relevance in respect of vibration here. The sound-insulating layered mats can have material thicknesses tailored as a function of the vibration amplitudes at the points of relevance in respect of vibration. The material thickness of the respectively applied sound-insulating layered mats can therefore vary.

BRIEF DESCRIPTION OF THE DRAWINGS

An advantageous exemplary embodiment of the invention is described below with reference to the accompanying figures, in which.

DETAILED DESCRIPTION OF EXEMPLARY EMBODIMENTS OF THE PRESENT INVENTION

Figure 1:
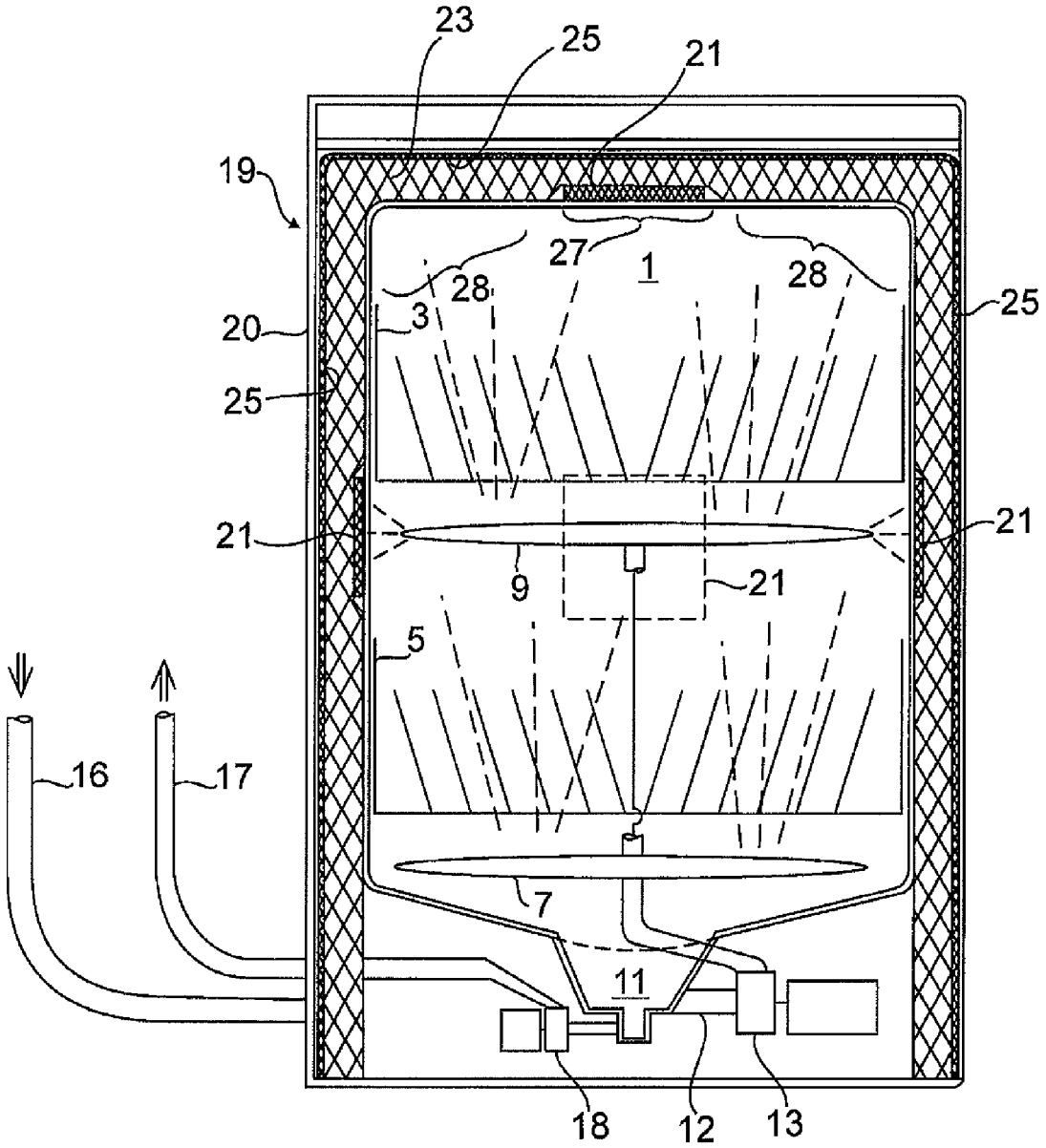
FIG. 1 shows a schematic sectional diagram of a dishwasher.

FIG. 1 shows a dishwasher with a wash compartment 1, in which items to be washed (not shown) can be disposed in racks 3, 5. Disposed in the illustrated wash compartment 1 are spray arms 7, 9 provided at two different spray levels, by way of which wash fluid is applied to the items to be washed. Configured in the wash compartment base is a sump 11, which is connected by way of a circulation line 12 to a downstream circulation pump 13. The circulation pump 13 conveys the wash fluid in a manner not shown in detail to the two spray arms 7, 9. The sump 11 is also connected by way of connectors to a fresh water supply line 16 coupled to the water supply network and to a discharge line 17, in which a drain pump for pumping the wash fluid out of the wash compartment 1 is disposed.

As also shown in FIG. 1, the wash compartment 1 is fitted inside an appliance housing 19 of the dishwasher. The housing walls 20 of the appliance housing 19 are separated from the wash compartment 1 here by a space.

The space is completely filled with an insulating layer material structure. For sound insulation and to deaden the sound from the wash compartment 1 said material structure has sound-insulating layered mats or sound-deadening layered mats 21, made of bitumen for example, which are applied at a distance from one another to parts of the outside of the wash compartment 1. The sound-insulating layered mats 21 only take up a very small proportion of the overall outer surface of the wash compartment 1, while the remaining outer surface of the wash compartment 1 is in direct contact with a thermally insulating layered mat 23, which can be configured for example from a cotton fleece. According to FIG. 1, in contrast to the sound-insulating layered mats 21, which are applied in a locally limited manner, the thermally insulating layered mat 23 encloses the side walls and the top wall of the wash compartment 1 completely. The thermally insulating layered mat 23 can close off free gaps between the wash compartment 1 and the housing 19, thereby preventing thermal convection within free gaps.

The insulating layered structure disposed between the wash compartment 1 and the housing walls 20 also consists of an additional sound-insulating layered mat 25. This is configured as a material composite with the thermally insulating layered mat 23 and according to FIG. 1 encloses the side and top walls of the wash compartment 1 completely. The outer sound-insulating layered mat 25 can be a heavy layer with correspondingly large mass, for example a bitumen layer.

According to the invention the sound-insulating layered mats or sound-deadening layered mats 21 are applied only at points of the wash compartment 1 that are of relevance in respect of vibration, to achieve structure-borne sound damping and sound deadening. To determine those points that are of relevance in respect of vibration, the vibration behavior of the wash compartment 1 is tested during appliance operation. Wash compartment wall regions 27 with a higher level of operational vibration and wash compartment wall regions 28 with a lower level of operational vibration can be determined, as shown in FIG. 1 by way of example in the region of the top wall of the wash compartment 1. By way of example such points of relevance in respect of vibration are the water input regions 27, which are frequently made to vibrate during operation of the appliance by water sprays of the spray arms 3, 5. In the figures the points of relevance in respect of vibration, in other words the wash compartment wall regions 27 with a higher level of operational vibration, are provided by way of example around the center of the side walls, the top wall and the rear wall respectively of the wash compartment 1.

The sound-insulating layered mats 21 can be for example bitumen or damping films with a very small mass. The bitumen mats 25 can also contain filler materials, which help to increase the mass. The filler materials used can be for example pulverized limestone or iron oxide powder. Ready made bitumen mats of this type are bonded to the wash compartments by means of hot-melt bond connections. The bitumen mats 21 here preferably have a material thickness in the region of 2 to 5 mm, while the thermally insulating layered mat 23 can preferably have a material thickness in the region of 10 to 20 mm.

Figure 2:
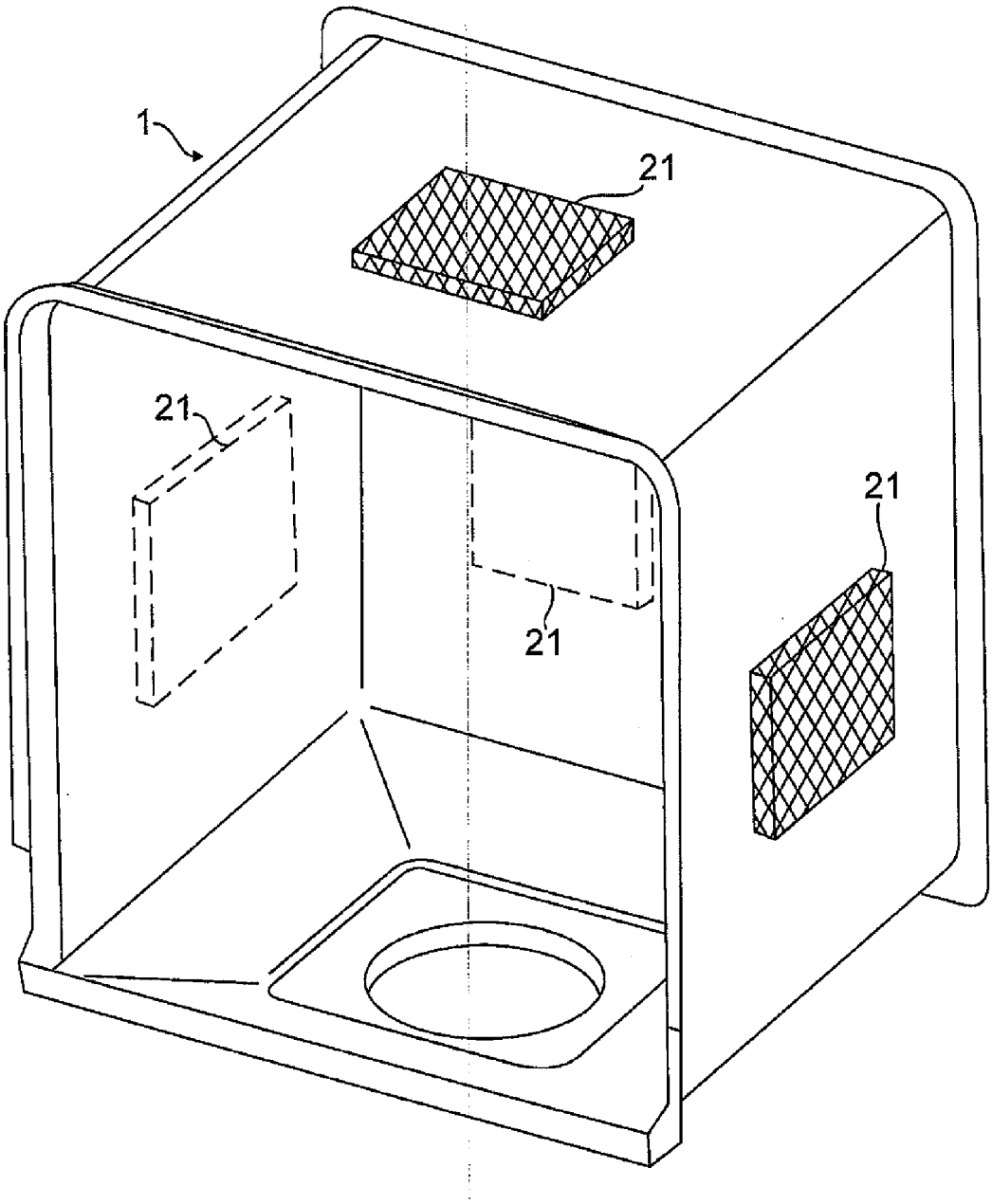
FIGS. 2 and 3 each show perspective views of the wash compartment in different production steps.
Figure 3:
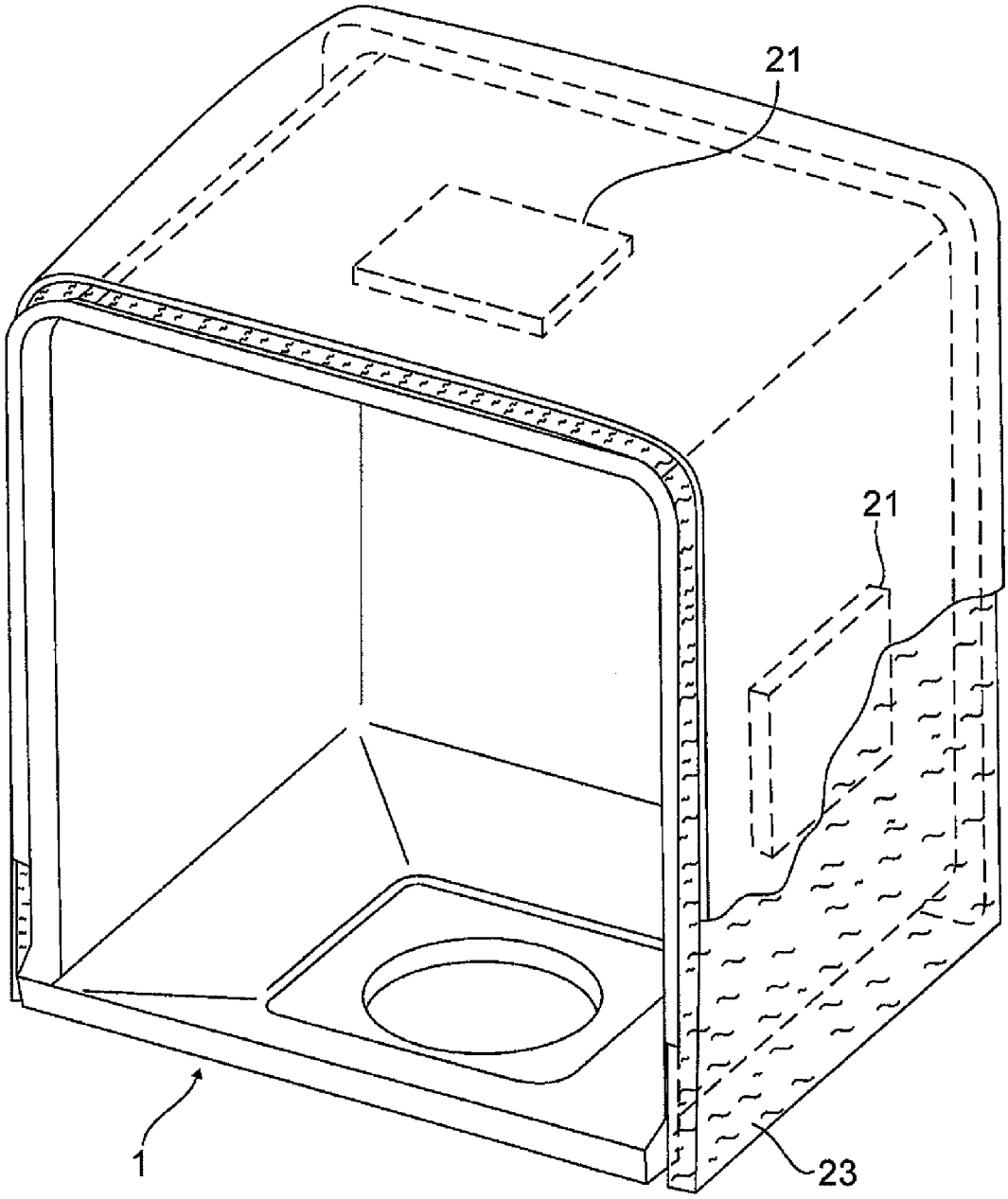

FIGS. 2 and 3 show the method steps for sound-insulating the wash compartment 1. According to FIG. 2 the sound-insulating layered mats 21 are bonded centrally and in a locally limited manner in each instance to the outside of the side walls, the rear wall and the top wall of the wash compartment 1. According to FIG. 3 the material composite made up of the thermally insulating layered mat 23 and sound-insulating layered mat 25 is then positioned over a large area of the wash compartment walls and the wash compartment 1 is introduced into the housing 19 together with the insulating layered structure.

The invention claimed is:

1. A water-conducting household appliance, comprising:

a wash compartment; and a spraying device configured to spray an interior of the wash compartment with liquid during operation of the water-conducting household appliance;

a sound-deadening first layered mat applied externally to a greater vibration region of a wall of the wash compartment, the first layered mat being confined to the greater vibration region, the greater vibration region corresponding to a location on the wall configured to experience a higher level of vibration during operation of the water-conducting household appliance than a lesser vibration region of the wall; and wherein the greater vibration region is a region in which liquid droplets striking the wall during operation of the water-conducting household appliance causes the higher level of vibration.

2. The water-conducting household appliance of claim 1, constructed in the form of a dishwasher.

3. The water-conducting household appliance of claim 1, wherein the first layered mat is a bitumen mat.

4. The water-conducting household appliance of claim 1, wherein the greater vibration region is a water input region.

5. The water-conducting household appliance of claim 1, further comprising a second layered mat applied at least to the lesser vibration region of the wall and made of a material different from a material of the first layered mat.

6. The water-conducting household appliance of claim 5, wherein the second layered mat is a thermally insulating layered mat or a sound absorption mat.

7. The water-conducting household appliance of claim 5, further comprising at least a sound-insulating third layered mat, which covers an area of the wall of the wash compartment that is larger that is than an area covered by the first layered mat.

8. The water-conducting household appliance of claim 7, wherein the third layered mat is disposed externally on the wall of the wash compartment.

9. The water-conducting household appliance of claim 7, wherein the third layered mat is disposed externally on the second layered mat.

10. The water-conducting household appliance of claim 8, wherein the second and third layered mats are configured as a single-piece material composite.

11. The water-conducting household appliance of claim 5, wherein the first and second layered mats form an insulating layered structure which is disposed without a gap between the wall of the wash compartment and an outer housing wall.

12. The water-conducting household appliance of claim 1, wherein the first layered mat has a material thickness which is tailored to a vibration amplitude generated in the greater vibration region.

13. The water-conducting household appliance of claim 1, wherein the wall of the wash compartment comprises a plurality of greater vibration regions and a plurality of said first layered mats are applied at a distance from one another, each of said plurality of first layered mats being confined to a respective greater vibration region.

14. The water-conduction household appliance of claim 13, wherein each of said plurality of first layered mats have a material thickness tailored to a vibration amplitude generated in the respective greater vibration region.

15. The water-conducting household appliance of claim 1, wherein a plurality of walls of the wash compartment comprise greater vibration regions and a plurality of said first layered mats are applied at a distance from one another, each of said plurality of first layered mats being confined to a respective greater vibration region.

16. The water-conduction household appliance of claim 15, wherein each of said plurality of first layered mats have a material thickness tailored to a vibration amplitude generated in the respective greater vibration region.

17. A method for producing the water-conducting household appliance of claim 1, the method comprising the steps of:

testing a vibration behavior of a wall of a wash compartment during operation of the household appliance;

determining the presence of the greater vibration region of the wall; and externally applying the sound-deadening first layered mat only to the greater vibration region.

18. The method of claim 17, further comprising the step of applying a second layered mat of a material different from a material of the first layered mat at least to the lesser vibration region.

19. The method of claim 17, wherein the first layered mat is a bitumen mat.

20. The method of claim 17, wherein the grater vibration region is a water input region.

21. The method of claim 18, wherein the second layered mat is a thermally insulating layered mat or a sound absorption mat.

22. The method of claim 18, further comprising the step of applying at least a sound-insulating third layered mat to cover an area of the wall of the wash compartment, an area of the third layered mat being larger than an area covered by the first layered mat.

23. The method of claim 22, wherein the third layered mat is disposed externally on the wall of the wash compartment.

24. The method of claim 22, wherein the third layered mat is disposed externally in the second layered mat.

25. The method of claim 22, wherein the second and third layered mats are configured as a single-piece material composite.

26. The method of claim 18, wherein the first and second layered mats form an insulating layered structure which is disposed without a gap between the wall of the wash compartment and an outer housing wall.

27. The method of claim 17, further comprising:

determining the presence of a plurality of greater vibration wall regions that experience higher levels of vibration during operation of water-conducting household appliance than at least one lesser vibration wall region with lower of operational vibration; and applying respective sound-deadening first layered mats at each greater vibration wall region, each sound-deadening first layered mat being applied at a distance from other sound-deadening first layered mats, Wherein the greater vibration regions are a regions in which liquid droplets striking an interior of the water-conducting household appliance during operation of the Water-conducting household appliance causes the higher levels of vibration.

* * * * *